US008643288B2

(12) United States Patent
Otake et al.

(10) Patent No.: US 8,643,288 B2
(45) Date of Patent: Feb. 4, 2014

(54) LIGHT-EMITTING DEVICE AND ILLUMINATION APPARATUS

(75) Inventors: Hirokazu Otake, Yokosuka (JP); Takuro Hiramatsu, Yokosuka (JP); Hiroshi Terasaka, Yokosuka (JP); Mitsuhiko Nishiie, Yokosuka (JP); Hiromichi Nakajima, Yokosuka (JP); Masahiko Kamata, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 305 days.

(21) Appl. No.: 12/764,995

(22) Filed: Apr. 22, 2010

(65) Prior Publication Data

US 2010/0270935 A1 Oct. 28, 2010

(30) Foreign Application Priority Data

Apr. 24, 2009 (JP) ..... 2009-106771
Mar. 25, 2010 (JP) ..... 2010-070543

(51) Int. Cl.
*H05B 37/00* (2006.01)

(52) U.S. Cl.
USPC ..... 315/185 R; 315/188; 315/126; 315/308; 315/291

(58) Field of Classification Search
USPC ..... 315/188, 231, 241 R, 185 R, 88, 90, 122, 315/126, 247, 291, 308, 312; 362/249.02, 362/249.11, 800; 323/233
See application file for complete search history.

(56) References Cited

U.S. PATENT DOCUMENTS

| | | | |
|---|---|---|---|
| 3,697,774 | A | 10/1972 | Pascente |
| 4,864,482 | A | 9/1989 | Quazi |
| 4,939,420 | A | 7/1990 | Lim |
| 5,632,551 | A | 5/1997 | Roney |
| 5,811,941 | A | 9/1998 | Barton |
| 5,834,924 | A | 11/1998 | Konopka |
| 6,153,980 | A | 11/2000 | Marshall |
| 6,186,646 | B1 | 2/2001 | Wiedemer |
| 6,234,649 | B1 | 5/2001 | Katougi |
| 6,628,093 | B2 | 9/2003 | Stevens |

(Continued)

FOREIGN PATENT DOCUMENTS

| | | | |
|---|---|---|---|
| CN | 2854998 | * | 12/2005 |
| EP | 1608206 | | 12/2005 |

(Continued)

OTHER PUBLICATIONS

English language abstract of JP-2008-053695 published Mar. 6, 2008.

(Continued)

*Primary Examiner* — Haiss Philogene
(74) *Attorney, Agent, or Firm* — DLA Piper LLP (US)

(57) ABSTRACT

A light-emitting device and an illumination apparatus are disclosed. A plurality of LED elements are connected in series between positive and negative lines, and first bypass capacitor is connected in parallel to the LED elements respectively. Each series circuit of a predetermined number of LED elements is connected in parallel to second bypass capacitors. As a result, with the negative power line set as a grounding point, the AC impedance at connection points of the series circuit of the LED elements against the ground is reduced. Thus, the erroneous lighting or "flicker" of each LED which otherwise might be caused by an external noise is prevented.

8 Claims, 12 Drawing Sheets

(56) References Cited

U.S. PATENT DOCUMENTS

| | | | | |
|---|---|---|---|---|
| 6,747,420 | B2 | 6/2004 | Barth | |
| 6,787,999 | B2 | 9/2004 | Stimac | |
| 6,969,977 | B1 | 11/2005 | Smith | |
| 6,998,792 | B2 | 2/2006 | Takahashi | |
| 7,081,709 | B2 | 7/2006 | Pak | |
| 7,102,340 | B1 | 9/2006 | Ferguson | |
| 7,106,036 | B1 | 9/2006 | Collins | |
| 7,164,235 | B2 | 1/2007 | Ito | |
| 7,202,608 | B2 | 4/2007 | Robinson | |
| 7,262,559 | B2 | 8/2007 | Tripathi | |
| 7,281,818 | B2 | 10/2007 | You | |
| 7,557,520 | B2 | 7/2009 | Chen | |
| 7,564,434 | B2 * | 7/2009 | Kim | 345/82 |
| 7,595,229 | B2 * | 9/2009 | Ihme et al. | 438/129 |
| 7,656,103 | B2 | 2/2010 | Shteynberg | |
| 7,791,326 | B2 | 9/2010 | Dahlman | |
| 7,804,256 | B2 | 9/2010 | Melanson | |
| 7,855,520 | B2 | 12/2010 | Leng | |
| 7,906,917 | B2 | 3/2011 | Tripathi et al. | |
| 7,976,182 | B2 | 7/2011 | Ribarich | |
| 7,999,484 | B2 * | 8/2011 | Jurngwirth et al. | 315/247 |
| 8,013,544 | B2 | 9/2011 | Negrete | |
| 8,018,171 | B1 | 9/2011 | Melanson | |
| 8,018,173 | B2 | 9/2011 | Shackle | |
| 8,044,608 | B2 | 10/2011 | Kuo | |
| 8,076,867 | B2 | 12/2011 | Kuo | |
| 8,076,920 | B1 * | 12/2011 | Melanson | 323/299 |
| 8,093,826 | B1 | 1/2012 | Eagar | |
| 8,098,021 | B2 | 1/2012 | Wang | |
| 8,102,127 | B2 | 1/2012 | Melanson | |
| 8,134,304 | B2 | 3/2012 | Hsu | |
| 8,212,491 | B2 | 7/2012 | Lost | |
| 8,212,494 | B2 | 7/2012 | Veltman | |
| 8,324,840 | B2 * | 12/2012 | Shteynberg et al. | 315/308 |
| 8,382,326 | B2 * | 2/2013 | Tamura | 362/249.02 |
| 2004/0012955 | A1 | 1/2004 | Hsieh | |
| 2005/0253533 | A1 | 11/2005 | Lys | |
| 2005/0254246 | A1 | 11/2005 | Huang | |
| 2006/0001381 | A1 | 1/2006 | Robinson | |
| 2006/0022916 | A1 | 2/2006 | Aiello | |
| 2006/0071614 | A1 | 4/2006 | Tripathi | |
| 2006/0119181 | A1 | 6/2006 | Namba | |
| 2006/0170370 | A1 | 8/2006 | De Anna | |
| 2006/0192502 | A1 | 8/2006 | Brown | |
| 2006/0238174 | A1 | 10/2006 | Russell | |
| 2006/0261754 | A1 * | 11/2006 | Lee | 315/291 |
| 2007/0030709 | A1 | 2/2007 | Kitagawa | |
| 2007/0069663 | A1 * | 3/2007 | Burdalski et al. | 315/312 |
| 2007/0182347 | A1 | 8/2007 | Shteynberg | |
| 2007/0183173 | A1 | 8/2007 | Wu | |
| 2007/0188112 | A1 | 8/2007 | Kang et al. | |
| 2007/0216320 | A1 | 9/2007 | Grivas | |
| 2008/0012502 | A1 * | 1/2008 | Lys | 315/247 |
| 2008/0054817 | A1 | 3/2008 | Kao | |
| 2008/0074058 | A1 | 3/2008 | Lee et al. | |
| 2008/0203934 | A1 | 8/2008 | Van Meurs | |
| 2008/0238387 | A1 | 10/2008 | Schmeller | |
| 2008/0258647 | A1 | 10/2008 | Scianna | |
| 2008/0258698 | A1 | 10/2008 | Kitagawa | |
| 2008/0259655 | A1 | 10/2008 | Wei | |
| 2008/0278092 | A1 | 11/2008 | Lys | |
| 2008/0316781 | A1 | 12/2008 | Liu | |
| 2009/0021470 | A1 | 1/2009 | Lee | |
| 2009/0079363 | A1 | 3/2009 | Ghoman | |
| 2009/0116232 | A1 | 5/2009 | Chang | |
| 2009/0121641 | A1 | 5/2009 | Shih | |
| 2009/0184616 | A1 | 7/2009 | Van de Ven | |
| 2009/0184662 | A1 | 7/2009 | Given | |
| 2009/0184666 | A1 | 7/2009 | Myers | |
| 2009/0294780 | A1 | 12/2009 | Chou | |
| 2009/0295300 | A1 | 12/2009 | King | |
| 2010/0013405 | A1 | 1/2010 | Thompson | |
| 2010/0013409 | A1 | 1/2010 | Quek | |
| 2010/0090618 | A1 | 4/2010 | Veltman | |
| 2010/0109570 | A1 * | 5/2010 | Weaver | 315/295 |
| 2010/0207534 | A1 | 8/2010 | Dowling | |
| 2010/0207536 | A1 | 8/2010 | Burdalski | |
| 2010/0213845 | A1 | 8/2010 | Aiello | |
| 2010/0289426 | A1 | 11/2010 | Takasaka | |
| 2010/0308742 | A1 | 12/2010 | Melanson | |
| 2011/0012523 | A1 | 1/2011 | Pasma | |
| 2011/0273095 | A1 | 11/2011 | Myers | |
| 2011/0291587 | A1 | 12/2011 | Melanson | |
| 2012/0139431 | A1 | 6/2012 | Thompson | |

FOREIGN PATENT DOCUMENTS

| | | |
|---|---|---|
| EP | 1689212 | 8/2006 |
| EP | 2257130 | 12/2010 |
| JP | 02-284381 | 11/1990 |
| JP | 09-045481 | 2/1997 |
| JP | 10-0064683 | 6/1998 |
| JP | 11-087072 | 3/1999 |
| JP | 2001-210478 | 8/2001 |
| JP | 2002-231471 | 8/2002 |
| JP | 2003-157986 | 5/2003 |
| JP | 2004-119078 | 4/2004 |
| JP | 2004-265756 | 9/2004 |
| JP | 2004-327152 | 11/2004 |
| JP | 2005-011739 | 1/2005 |
| JP | 2005-129512 | 5/2005 |
| JP | 2006-054362 | 2/2006 |
| JP | 2006-108117 | 4/2006 |
| JP | 2006-210835 | 8/2006 |
| JP | 2006-269349 | 10/2006 |
| JP | 2007-6658 | 1/2007 |
| JP | 2007-042758 | 2/2007 |
| JP | 2007-189004 | 7/2007 |
| JP | 2007-234415 | 9/2007 |
| JP | 2007-281424 | 10/2007 |
| JP | 2007-306644 | 11/2007 |
| JP | 2007-538378 | 12/2007 |
| JP | 2008-504654 | 2/2008 |
| JP | 2008-053663 | 3/2008 |
| JP | 2008-053695 | 3/2008 |
| JP | 41-23866 | 5/2008 |
| JP | 2008-210537 | 9/2008 |
| JP | 2008-310963 | 12/2008 |
| JP | 2009-123681 | 6/2009 |
| JP | 2009-218528 | 9/2009 |
| JP | 2009-232625 | 10/2009 |
| JP | 2010-021433 | 1/2010 |
| JP | 2010-080844 | 4/2010 |
| WO | WO 99/56504 | 11/1999 |
| WO | WO 03/096761 | 11/2003 |
| WO | WO 2005/115058 | 12/2005 |
| WO | WO 2006/120629 | 11/2006 |
| WO | WO 2008/029108 | 3/2008 |
| WO | WO 2009/014418 | 1/2009 |
| WO | WO 2009/055821 | 4/2009 |
| WO | WO 2009/119617 | 10/2009 |

OTHER PUBLICATIONS

Machine English language translation of JP-2008-053695 published Mar. 6, 2008.

English Language Abstract of JP 2008-210537, published Sep. 11, 2008.

Machine English Language Translation of JP 2008-210537, published Sep. 11, 2008.

Related U.S. Appl. No. 12/777,303.

English language abstract of JP-2007-538378 published Dec. 27, 2007.

Machine English language translation of JP-2007-538378 published Dec. 27, 2007.

English language abstract of JP 2005-11739 published Jan. 13, 2005.

Machine English language translation of JP 2005-11739 published Jan. 13, 2005.

English language abstract of JP 11-087072 published Mar. 30, 1999.

Machine English language translation of JP 11-087072 published Mar. 30, 1999.

English Language Abstract of JP 2009-218528 Published Sep. 24, 2009.

(56) References Cited

OTHER PUBLICATIONS

English Language Translation of JP 2009-218528 Published Sep. 24, 2009.
English Language Abstract of JP 2004-119078 Published Apr. 15, 2004.
English Language Translation of JP 2004-119078 Published Apr. 15, 2004.
English Language Abstract of JP 2007-6658 Published Jan. 11, 2007.
English Language Translation of JP 2007-6658 Published Jan. 11, 2007.
English Language Abstract of JP 2003-157986 Published May 30, 2003.
English Language Translation of JP 2003-157986 Published May 30, 2003.
English Language Abstract of JP 2008-310963 Published Dec. 25, 2008.
English Language Translation of JP 2008-310963 Published Dec. 25, 2008.
English Language Abstract of JP 2002-231471 Published Aug. 15, 2002.
English Language Translation of JP 2002-231471 Published Aug. 15, 2002.
English Language Abstract of JP 2004-327152 Published Nov. 18, 2004.
English Language Translation of JP 2004-327152 Published Nov. 18, 2004.
English Language Abstract of JP 2005-129512 Published May 19, 2005.
English Language Translation of JP 2005-129512 Published May 19, 2005.
English Language Abstract of JP 2007-234415 Published Sep. 13, 2007.
English Language Translation of JP 2007-234415 Published Sep. 13, 2007.
English Language Abstract of JP 2001-210478 Published Aug. 3, 2001.
English Language Translation of JP 2001-210478 Published Aug. 3, 2001.
English Language Abstract of JP 2006-269349 Published Oct. 5, 2006.
English Language Translation of JP 2006-269349 Published Oct. 5, 2006.
Extended European Search Report issued in EP 10177426.3 on May 4, 2011.
Extended European Search Report issued in EP 10162031.8 on Jul. 21, 2011.
Chinese Office Action mailed Jul. 21, 2011 in CN 201010178232.8.
English Language Translation of Chinese Office Action mailed Jul. 21, 2011 in CN 201010178232.8.
Japanese Office Action issued in JP 2008-076837 on Jul. 6, 2010.
English Translation of Japanese Office Action issued in JP 2008-076837 on Jul. 6, 2010.
English Language Abstract of JP 2006-108117 published Apr. 20, 2006.
Machine Translation of JP 2006-108117 published Apr. 20, 2006.
English Language Abstract of JP 2008-281424 published Nov. 20, 2008.
Machine Translation of JP 2008-281424 published Nov. 20, 2008.
Japanese Office Action issued in JP 2008-076835 on Aug. 24, 2010.
English Translation of Japanese Office Action issued in JP 2008-076835 on Aug. 24, 2010.
Extended European Search Report issued in European Appl. 09011497.6 on Jan. 28, 2010.
English Language Abstract of JP 2004-265756 published on Sep. 24, 2004.
English Language Translation of JP 2004-265756 published on Sep. 24, 2004.
Japanese Office Action issued in JP 2008-076837 on Nov. 24, 2010.
English Translation of Japanese Office Action issued in JP 2008-076837 on Nov. 24, 2010.
English Abstract of JP 2009-232625 published Oct. 8, 2009.
English Translation of JP 2009-232625 published Oct. 8, 2009.
English Abstract of JP 2007-306644 published Nov. 22, 2007.
English Translation of JP 2007-306644 published Nov. 22, 2007.
Extended European Search Report issued in EP 10173250.1-1239 on Oct. 19, 2012.
European Office Action issued in EP10175037 on Sep. 7, 2012.
Extended European Search Report issued in EP 1015037 Dec. 15, 2011.
International Preliminary Report on Patentability and Written Opinion mailed Nov. 18, 2010 in PCT/JP2009/055871.
International Preliminary Report on Patentability and Written Opinion mailed Nov. 18, 2010 in PCT/JP2009/055873.
Japanese Office Action issued in JP 2010-213133 on Jun. 14, 2012.
English Language Translation of Japanese Office Action issued in JP 2010-213133 on Jun. 14, 2012.
English Language Abstract of JP 2009-189004 published Jul. 26, 2007.
English Language Translation of JP 2009-189004 published Jul. 26, 2007.
English Language Abstract of JP 2006-210835 published Aug. 10, 2006.
English Language Translation of JP 2006-210835 published Aug. 10, 2006.
English Language Abstract of JP 2009-123681 published Jun. 4, 2009.
English Language Translation of JP 2009-123681 published Jun. 4, 2009.
Japanese Office Action issued in JP 2010-235474 on Apr. 19, 2012.
English Language Translation of Japanese Office Action issued in JP 2010-235474 on Apr. 19, 2012.
English Language Abstract of JP 2008-504654 published Feb. 14, 2008.
English Language Translation of JP 2008-504654 published Feb. 14, 2008.
Japanese Office Action issued in JP 2010-235473 mailed Jul. 19, 2012.
Enolish Language Translation of Japanese Office Action issued in JP 2010-235473 mailed Jul. 19, 2012.
Enalish Language Abstract of JP 2007-042758 published Feb. 15, 2007.
English Language Translation of JP 2007-042758 published Feb. 15, 2007.
International Search Report issued in PCT/JP2009/055871 on Jun. 9, 2009.
International Search Report issued in PCT/JP2009/055873 on Jun. 9, 2009.
Supplementary European Search Report issued in EP 09725738 on Aug. 17, 2012.
Notice for Corresponding Japanese Patent Application No. 2010-196338 mailed Jul. 12, 2012.
English Translation of Notice for Corresponding Japanese Patent Application No. 2010-196338 mailed Jul. 12, 2012.
Japanese Office Action issued in JP2010-196338 mailed Jul. 26, 2012.
English Language Translation of Japanese Office Action issued in JP2010-196338 mailed Jul. 26, 2012.
European Office Action issued in EP 09725489 mailed Aug. 17, 2012.
English Language Abstract of JP 2006-054362 published Feb. 23, 2006.
English Language Translation of JP 2006-054362 published Feb. 23, 2006.
English Language Abstract of JP 2-284381 published Nov. 21, 1990.
English Language Abstract of JP 09-045481 published Feb. 14, 1997.
English Language Translation of JP 09-045481 published Feb. 14, 1997.
English Language Abstract of JP 10-064683 published Jun. 3, 1998.
English Language Translation of JP 10-064683 published Jun. 3, 1998.
U.S. Appl. No. 12/777,303.
U.S. Appl. No. 12/873,348.
U.S. Appl. No. 12/874,282.

(56) References Cited

OTHER PUBLICATIONS

U.S. Appl. No. 12/885,053.
U.S. Appl. No. 12/860,528.
U.S. Appl. No. 12/557,179.
U.S. Appl. No. 12/873,744.
U.S. Appl. No. 12/873,759.
U.S. Appl. No. 13/687,973.
Partial Image File Wrapper of U.S. Appl. No. 12/885,053 electronically captured on Jul. 8, 2013 between Apr. 8, 2013, 2013 to Jul. 8, 2013.
Japanese Office Action issued in JP 2010-070543 on May 7, 2013.
English Language Translation of Japanese Office Action issued in JP 2010-070543 on May 7, 2013.
English Language Abstract of JP 2008-053663 published Mar. 6, 2008.
English Language Translation of JP 2008-053663 published Mar. 6, 2008.
English Language Abstract of JP 2010-021433 published Jan. 28, 2010.
Entlish Language Translation of JP 2010-021433 published Jan. 28, 2010.
English Language Abstract of JP 2010-080844 published Apr. 8, 2010.
English Language Translation of JP 2008-080844 published Apr. 8, 2010.
Image File Wrapper of U.S. Appl. No. 12/777,303 electronically captured on Jul. 26, 2013.
Image File Wrapper of U.S. Appl. No. 12/557,179 electronically captured on Jul. 26, 2013.
Image File Wrapper of U.S. Appl. No. 12/873,759 electronically captured on Jul. 26, 2013.
Partial Image File Wrapper of U.S. Appl. No. 12/873,348 electronically captured on Jul. 8, 2013 between Apr. 8, 2013, 2013 to Jul. 8, 2013.
Partial Image File Wrapper of U.S. Appl. No. 12/874,282 electronically captured on Jul. 8, 2013 between Apr. 8, 2013, 2013 to Jul. 8, 2013.
Partial Image File Wrapper of U.S. Appl. No. 12/885,053 electronically captured on Jul. 8, 2013 betviteen Apr. 8, 2013, 2013 to Jul. 8, 2013.
Partial Image File Wrapper of U.S. Appl. No. 12/777,303 electronically captured on Nov. 19, 2013 between Aug. 19, 2013 and Nov. 19, 2013.
Partial Image File Wrapper of U.S. Appl. No. 12/873,348 electronically captured on Nov. 19, 2013 between Aug. 19, 2013 and Nov. 19, 2013.
Partial Image File Wrapper of U.S. Appl. No. 12/777,303 electronically captured on Oct. 24, 2013 between Jul. 24, 2013 and Oct. 24, 2013.
Partial Image File Wrapper of U.S. Appl. No. 12/874,282 electronically captured on Oct. 24, 2013 between Jul. 24, 2013 and Oct. 24, 2013.
Partial Image File Wrapper of U.S. Appl. No. 12/557,179 electronically captured on Oct. 24, 2013 between Jul. 24, 2013 and Oct. 24, 2013.
Partial Image File Wrapper of U.S. Appl. No. 13/776,409 electronically captured on Oct. 24, 2013 between Jul. 24, 2013 and Oct. 24, 2013.
Partial Image File Wrapper of U.S. Appl. No. 12/873,348 electronically captured on Oct. 24, 2013 between Jul. 24, 2013 and Oct. 24, 2013.
Partial Image File Wrapper of U.S. Appl. No. 13/687,973 electronically captured on Oct. 24, 2013 between Jul. 24, 2013 and Oct. 24, 2013.

* cited by examiner

LIGHT-EMITTING DEVICE AND ILLUMINATION APPARATUS

CROSS-REFERENCE TO RELATED APPLICATIONS

This application is based upon and claims the benefit of priority from prior Japanese Patent Applications No. 2009-106771, filed Apr. 24, 2009; and No. 2010-070543, filed Mar. 25, 2010, the entire contents of both of which are incorporated herein by reference.

BACKGROUND OF THE INVENTION

1. Field of the Invention

The present invention relates to a light-emitting device and an illumination apparatus using a semiconductor light-emitting element such as a light-emitting diode (LED element) as a light source.

2. Description of the Related Art

A conventional illumination apparatus which includes a plurality of LED elements connected in series-parallel as disclosed in Jpn. Pat. Appln. KOKAI Publication No. 2008-053695 is available. Also, an illumination apparatus is available which, as shown in FIG. 17, comprises a power circuit 101 and an LED module 102 constituting a light-emitting device in a housing 100 of the illumination apparatus proper. In this conventional apparatus, the power circuit 101 is connected to a commercial power supply 104 through a power switch 103, and by the switching operation of a switching element, not shown, with the power switch 103 turned on, controls the DC output to the LED module 102. The LED module 102 is configured of a plurality of series-connected LED elements 105 mounted on the surface of a printed board 106 and adapted to be turned on with the LED elements 105 as a light source by the DC output of the power circuit 101.

The illumination apparatus of this type is used with the housing 100 grounded for protection against an electric shock, etc. In this case, the printed board 106 with the LED elements 105 mounted thereon is fixed closely on the inner wall of the housing 100 taking the heat radiation into consideration, and therefore, stray capacitance 107 exists between the printed board 106 and the housing 100. If a thin printed board is used to improve the efficiency of radiating the heat generated by the LED elements, the stray capacitance increases. The stray capacitance further increases especially for an LED module in which an insulating layer is formed on the surface of a metal board and the LED elements 105 are formed thereon.

In the case where a common-mode noise (with the ground) is generated by an external noise source 108 such as a high-frequency variation or an impulse noise which causes the instability of the grounding potential, therefore, a noise current may flow into the LED elements 105 through the stray capacitance 107. Especially, in the case where the power switch 103 of single-side type as shown is used, the noise current may continue to flow into the LED elements 105 through the path indicated by a dashed line a and may erroneously turn on the LED elements 105 in spite of the off state of the power switch 103. Also, in the case where the LED elements 105 of the illumination apparatus having the dimmer function are turned on with a deep (dark) dim light, the problem is sometimes posed that the current flowing into the LED elements 105 due to the common-mode noise may cause a flicker, thereby having an extremely adverse effect on the commercial value.

A solution to this problem has been conceived in which a bypass capacitor is connected in parallel to each of the series-connected LED elements 105 to provide a bypass for the current flowing through the stray capacitance 107 due to the common-mode noise.

With the increase in the number of the series-connected LED elements 105 and hence the number of the capacitors connected in parallel to the LED elements 105, however, the fact that the plurality of the capacitors are connected substantially in series decreases the combined capacitance of the capacitors as a whole and increases the AC impedance against the ground, resulting in a reduced bypass effect. Thus, the LED elements 105 connected to a higher potential side would be erroneously turned on by the current inflow due to the common-mode noise. The use of a large-capacitance capacitor may be considered to solve this problem. A capacitor of large capacitance, however, increases both the size and cost of the apparatus, and would lead to bulkiness and a high price of the whole illumination apparatus.

As a method of reducing the effect of the common-mode noise on the LED elements, an insulation-type switching transformer may also be used for the power circuit 101. In the insulation-type switching transformer, however, a capacitor is inserted between the primary and secondary windings to suppress noises, and therefore, the effect of the common-mode noise cannot be completely eliminated. Further, the use of the insulation-type switching transformer poses the problem of a bulky and expensive power circuit.

BRIEF SUMMARY OF THE INVENTION

An object of the present invention is to provide a light-emitting device and an illumination apparatus capable of positively removing the effect of an external noise.

According to an embodiment of the invention, a plurality of LED elements is connected in series between positive and negative lines, and a first bypass capacitor is connected in parallel to each LED element. Also, a second bypass capacitor is connected in parallel to each series circuit including a predetermined number of the LED elements. As a result, with the negative line as a grounding point, the AC impedance against the ground at each connection point of the series circuit of the plurality of the LED elements is reduced.

DETAILED DESCRIPTION OF THE INVENTION

Figure 1:
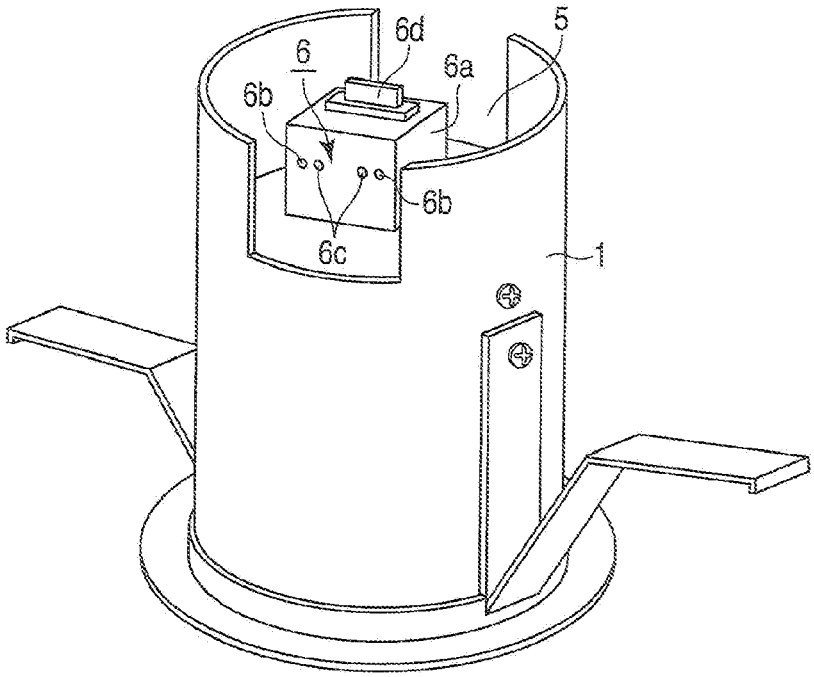
FIG. 1 is a perspective view of an illumination apparatus according to a first embodiment of the invention.

Various embodiments according to the invention will be described hereinafter. In general, according to a first aspect of the invention, there is provided a light-emitting device comprising: a plurality of first bypass capacitors connected substantially in parallel to the semiconductor light-emitting elements; and a second bypass capacitor connected in parallel to said first bypass capacitors in such a manner as to reduce the AC impedance at desired connection points of said plurality of the semiconductor light-emitting elements against the grounding point of said plurality of the semiconductor light-emitting elements as a reference.

With this configuration, the current flowing into the semiconductor light-emitting elements by way of the stray capacitance can be efficiently led to the grounding point through a bypass formed of the second bypass capacitor, and therefore, the effect of external noises can be positively shut out.

According to a preferred aspect of the invention, the series circuit of a plurality of semiconductor light-emitting elements is connected between the positive and negative lines of the DC output and an arbitrary connection point of the plurality of the semiconductor light-emitting elements is grounded. By doing so, a grounding point to reduce the AC impedance against the ground can be easily secured with respect to the desired connection point of the semiconductor light-emitting elements.

According to a second aspect of the invention, the light-emitting device further comprises a third bypass capacitor (513*b*) connected to a predetermined number of the first bypass capacitors different from the first bypass capacitors-connected to the second bypass capacitor; wherein the ratio between a combined capacitance of the second bypass capacitor and the first bypass capacitors connected to the second bypass capacitor and a combined capacitance of the third bypass capacitor and the predetermined number of the first bypass capacitors is set to be an inverse ratio between the number of the semiconductor light-emitting elements connected to said second bypass capacitors and the predetermined number.

As a result, even in the case where the series circuits of the semiconductor light-emitting elements connected in parallel to the second and third bypass capacitors, respectively, have different numbers of elements, the noise voltage applied to each semiconductor light-emitting element can be equalized, and the light-emission "flicker" of the semiconductor light-emitting elements is prevented.

According to a third aspect of the invention, there is provided a light-emitting device comprising: a plurality of semiconductor light-emitting elements connected in series with each other; and a plurality of first bypass capacitor connected in parallel to the semiconductor light-emitting elements in such a manner as to reduce the AC impedance at desired connection points of said plurality of the semiconductor light-emitting elements against the grounding point of said plurality of the semiconductor light-emitting elements as a reference.

In this way, the current flowing into the semiconductor light-emitting elements through the stray capacitance can be efficiently led to the grounding point only by a bypass formed of the first bypass capacitors, and the effect of external noises can thus be positively shut out while at the same time realizing a compact, inexpensive light-emitting device.

According to a fourth aspect of the invention, the light-emitting device comprises a dimmer which adjusts the light emission strength of the semiconductor light-emitting elements.

Thus, in addition to the advantages described above, a light-emitting device having variable brightness is provided.

According to a fifth aspect of the invention, there is provided an illumination apparatus comprising: the light-emitting device described in any one of the first to fourth aspects; and a power supply unit which supplies a DC output to the light-emitting device.

As a result, there is provided an illumination apparatus including a light-emitting device in which the effect of external noises can be positively shut out.

Embodiments of the invention are described below with reference to the drawings.

First Embodiment

Figure 2:
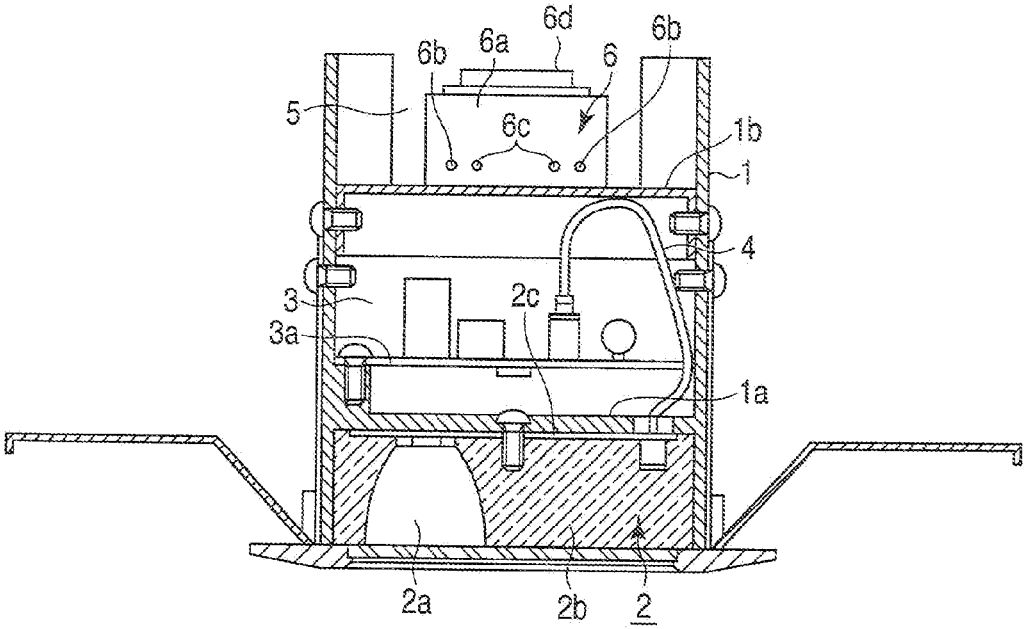
FIG. 2 is a sectional view of the illumination apparatus according to the first embodiment.

First, an illumination apparatus according to the present invention is briefly explained. In FIGS. 1 and 2, a housing 1 of the apparatus proper is formed of die-cast aluminum and in the shape of a cylinder open at both ends thereof. The interior of the housing 1 is divided vertically into three parts by partitioning members 1*a* and 1*b*, and the space between the lower opening and the partitioning member 1*a* is formed in a light source unit 2. The light source unit 2 includes a plurality of LEDs 2*a* as semiconductor light-emitting elements and a reflector 2*b*. The plurality of the LEDs 2*a* are arranged and mounted equidistantly along the circumference of a discal wiring board 2*c* arranged on the lower surface of the partitioning member 1*a*.

The space between the partitioning members 1*a* and 1*b* of the housing 1 is formed in a power chamber 3. The wiring board 3*a* is arranged above the partitioning member 1*a* of the power chamber 3. Electronic parts making up a power circuit to drive the plurality of the LEDs 2*a* are arranged on the wiring board 3*a*. This power circuit is connected to the plurality of the LEDs 2*a* by a lead wire 4.

The space between the partitioning member 1*b* and the upper opening of the housing 1 is formed in a power terminal chamber 5. A power terminal rest 6 is arranged on the partitioning member 1*b* of the power terminal chamber 5. The power terminal rest 6 is configured to supply the AC power of the commercial power supply to the power circuit of the power chamber 3, and includes, on both sides of a box 6*a* of electrically insulative synthetic resin, an insertion hole 6*b* providing a power cable terminal, an insertion hole 6*c* providing a feed cable terminal and a release button 6*d* configured to separate a power line and a feed line from each other.

Figure 3:
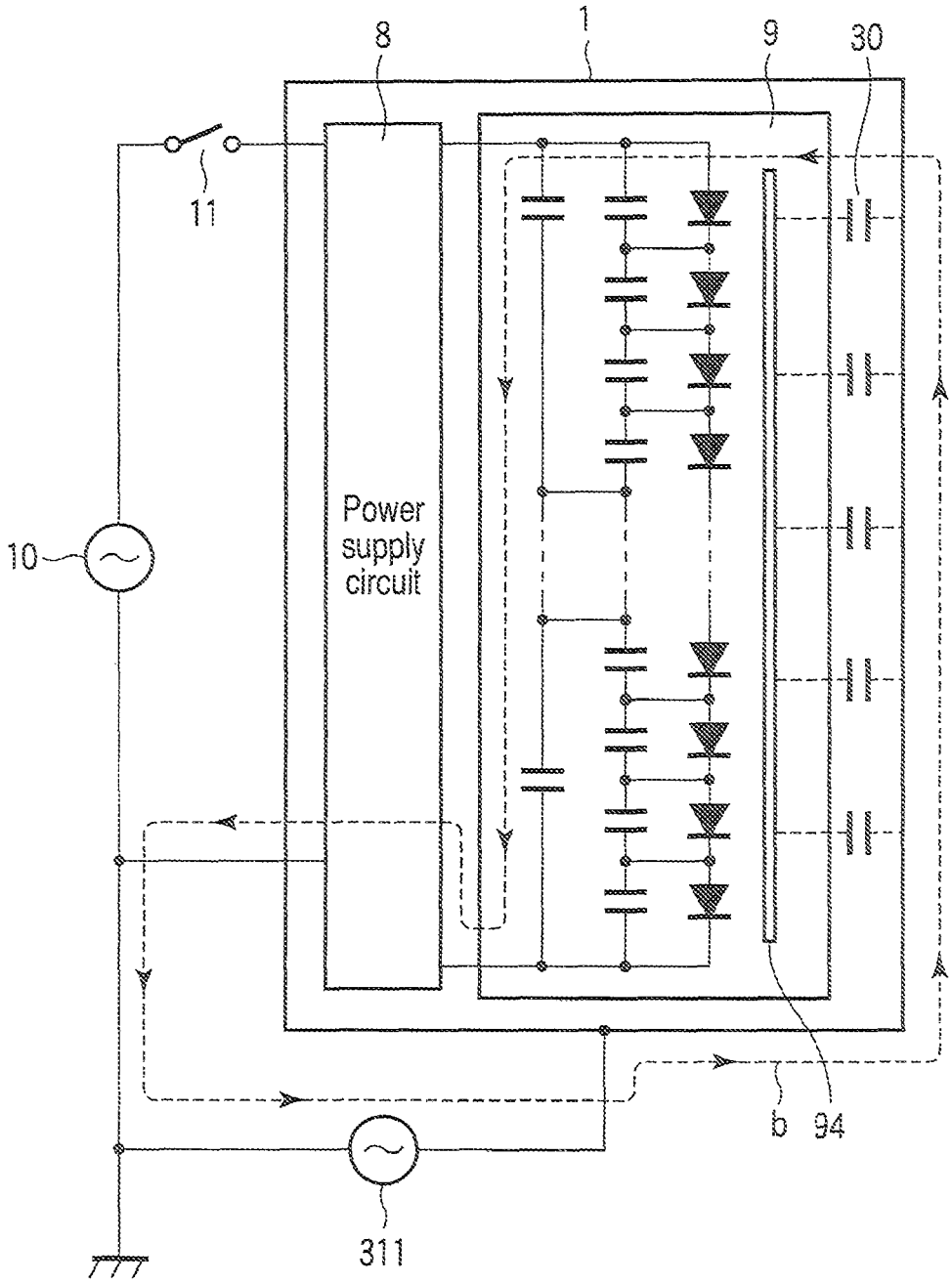
FIG. 3 is a diagram showing a general configuration of the illumination apparatus according to the first embodiment.

FIG. 3 shows the circuit configuration of the illumination apparatus configured as described above according to an embodiment.

In FIG. 3, a housing 1 of the apparatus proper contains a power circuit 8 as a power supply, and an LED module (corresponding to LED 2*a* in FIG. 1) 9 as a light-emitting device.

Figure 4:
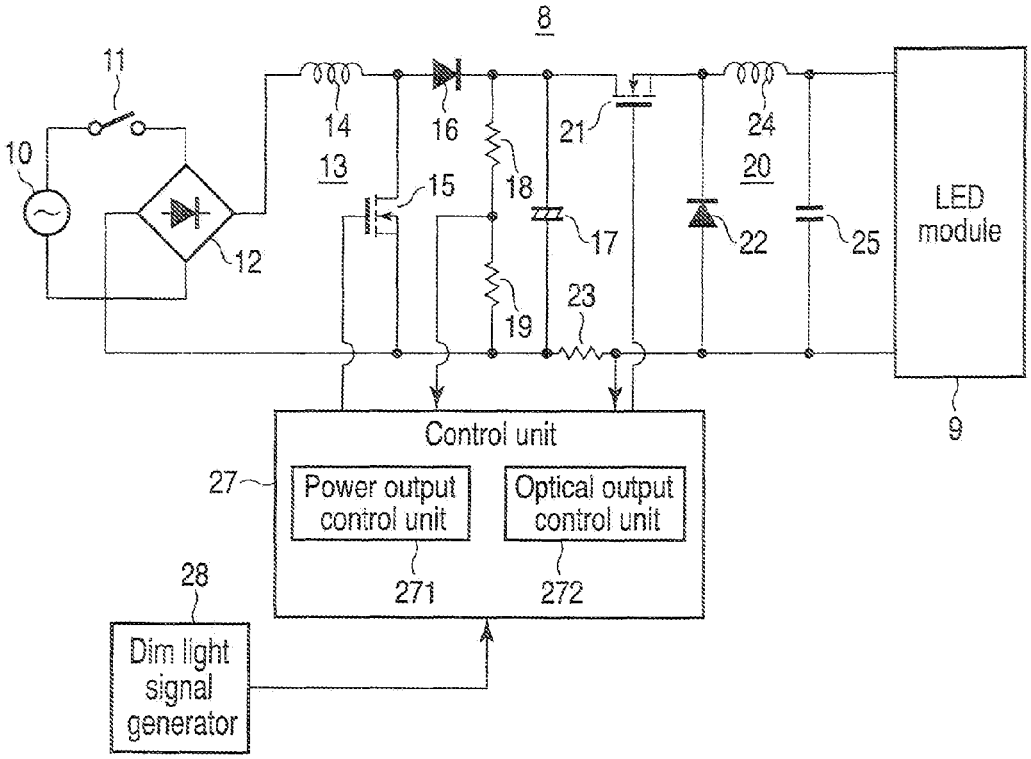
FIG. 4 is a diagram showing a general configuration of a power circuit used for the illumination apparatus according to the first embodiment.

FIG. 4 shows a general configuration of the power circuit 8.

In FIG. 4, an AC power supply 10 is a commercial power supply. The AC power supply 10 is connected with an input terminal of a full-wave rectification circuit 12 through a power switch 11. The full-wave rectification circuit 12 generates a DC output by full-wave rectifying the AC power from the AC power supply 10.

The full-wave rectification circuit 12 is connected with a boosting chopper circuit 13 as a power supply unit. The boosting chopper circuit 13 is configured in such a manner that a series circuit of a first inductor 14 making up a boosting transformer and a field-effect transistor 15 making up a switching element is connected between the positive and negative output terminals of the full-wave rectification circuit 12. The field-effect transistor 15 is connected with a series circuit of a flywheel diode 16 of shown polarity and an electrolytic capacitor 17 making up a smoothing capacitor in parallel to the field-effect transistor 15. The two terminals of the electrolytic capacitor 17 are connected to a series circuit of resistors 18 and 19 as a voltage detection unit. The resistors 18 and 19 generate a division voltage from the terminal voltage of the electrolytic capacitor 17, of which the terminal voltage of the resistor 19 is output to a control unit 27. The field-effect transistor 15 is turned on/off based on the result of comparison between the terminal voltage of the resistor 19 of the control unit 27 and a reference voltage prepared in advance. The first inductor 14 causes the electrolytic capacitor 17 to generate a boosted output through the flywheel diode 16 by the accumulation and discharge of electromagnetic energy with the on/off operation of the field-effect transistor 15. The control unit 27 is described later.

The boosting chopper circuit 13 is connected with a step-down chopper circuit 20 as an output generating unit. This step-down chopper circuit 20 is configured in such a manner that a series circuit including a field-effect transistor 21 constituting a switching element, a flywheel diode 22 and a resistor 23 constituting a load current detection unit is connected across the electrolytic capacitor 17. Also, the step-down chopper circuit 20 includes a series circuit of a second inductor 24 and a smoothing capacitor 25 connected across the flywheel diode 22. The resistor 23 detects the load current flowing in an LED module 9 described later, and outputs the detection output of the load current to the control unit 27. The field-effect transistor 21 is turned on/off by the control unit 27 based on the result of comparison between the output corresponding to the load current detected by the resistor 23 and a reference voltage prepared in advance. The second inductor 24 generates a stepped-down DC output across the capacitor 25 due to the accumulation and discharge of electromagnetic energy with the on/off operation of the field-effect transistor 21. The step-down chopper circuit 20 is connected with the LED module 9.

The control unit 27 is configured to control the power supply unit as a whole and includes a power output control unit 271 and an optical output control unit 272. The power output control unit 271, in which a reference voltage not shown is stored, controls the on/off operation of the field-effect transistor 15 based on the result of comparison between the reference voltage and the terminal voltage of the resistor 19. As the result of the accumulation and discharge of electromagnetic energy in the first inductor 14 with the on/off operation of the field-effect transistor 15, a boosted output voltage is generated across the electrolytic capacitor 17. The optical output control unit 272, in which a reference voltage not shown is prepared as a reference value, turns on/off the field-effect transistor 21 based on the result of comparison between the reference voltage and the output voltage corresponding to the load current detected by the resistor 23.

Figure 5A:
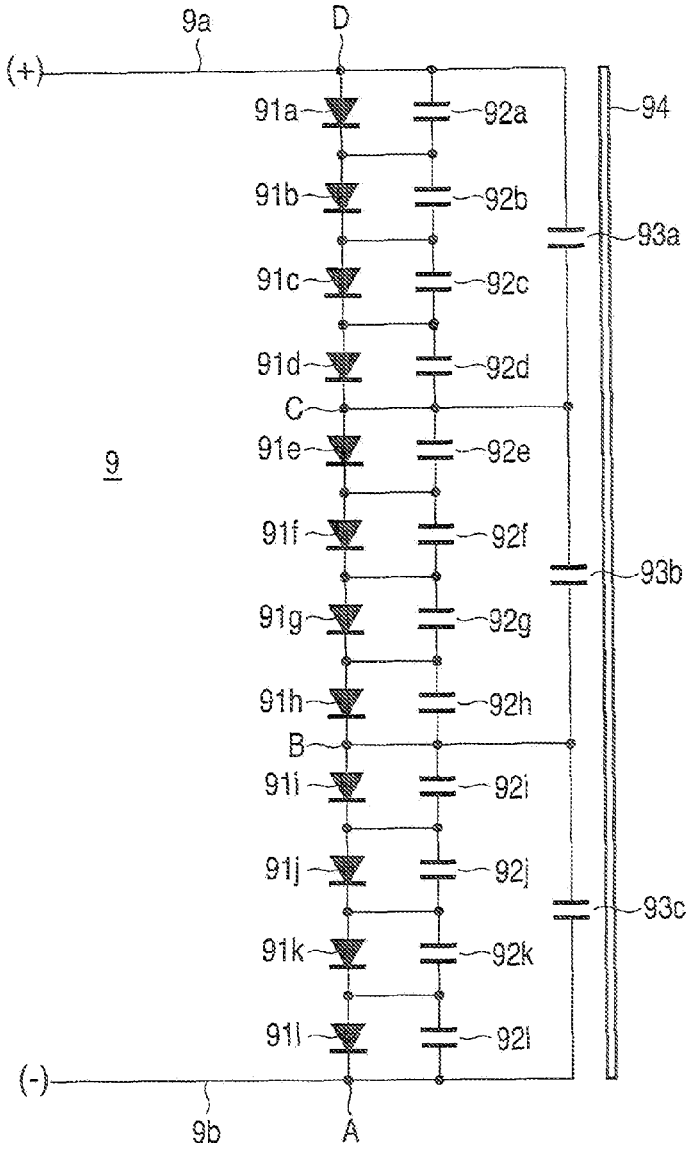
FIG. 5A is a diagram for explaining the detailed configuration of the LED module used for the illumination apparatus according to the first embodiment.

The LED module 9, as shown in FIG. 5A, for example, includes a plurality of (twelve, in the shown example) LED elements 91*a* to 91*l* as semiconductor light-emitting elements connected in series, and this series circuit is connected between positive and negative lines 9*a* and 9*b* of the DC output. The LED elements 91*a* to 91*l* are connected in parallel to first bypass capacitors 92*a* to 92*l*, respectively. The first bypass capacitors 92*a* to 92*l* constitute a bypass through which a noise current which otherwise might flow into the LED elements 91*a* to 91*l* as a common-mode noise passes. Further, each group including a plurality of (four, in the shown example) ones of the series-connected LED elements 91*a* to 91*l* is connected in parallel to second bypass capacitors 93*a*, 93*b* and 93*c*. The second bypass capacitors 93*a*, 93*b* and 93*c* include a negative line 9*b* as a grounding point A, and with this grounding point A as a reference, the AC impedance against the ground at the desired connection points, that is, the connection points B, C, D, in this case, of the series circuit of the LED elements 91*a* to 91*l* is reduced for an improved bypass effect.

The LED elements 91*a* to 91*l*, the first bypass capacitors 92*a* to 92*l* and the second bypass capacitors 93*a*, 93*b* and 93*c* are configured as the LED module 9 mounted on a printed board 94.

Incidentally, the LED module 9 may alternatively be configured of a plurality of parallel-connected series circuits each including a plurality of LED elements connected in series.

Returning to FIG. 4, the control unit 27 is connected with a dim light signal generator 28. The dim light signal generator 28 generates a PWN signal having a different duty factor as a dim light signal of a different dim light depth based on an external dim light operation signal. Based on this dim light operation signal, the control unit 27 changes the reference voltage and hence the strength (brightness) of the optical output of the LED module 9.

Next, the operation of an embodiment having the above-mentioned configuration is explained.

First, the operation of the power circuit 8 is explained briefly. With the power switch 11 turned on, the AC power of the AC power supply 10 is full-wave rectified by the full-wave rectification circuit 12 and supplied to the boosting chopper circuit 13. In the boosting chopper circuit 13, the field-effect transistor 15 is turned on/off based on the result of comparison between the reference voltage prepared in the power output control unit 271 and the terminal voltage of the resistor 19. Due to the accumulation and discharge of the electromagnetic energy of the first inductor 14, with the on/off operation of the field-effect transistor 15, a boosted output voltage is generated in the electrolytic capacitor 17 through the flywheel diode 16.

The output voltage of the boosting chopper circuit 13 is supplied to a step-down voltage chopper circuit 20. The step-down voltage chopper circuit 20 turns on/off the field-effect transistor 21 based on the result of comparison between the reference voltage prepared in the optical output control unit 272 and the output voltage corresponding to the load current detected by the resistor 23. Due to the accumulation and discharge of the electromagnetic energy of the second inductor 24 with the on/off operation of the field-effect transistor 21, a stepped-down DC voltage (DC output) is generated across the capacitor 25. This DC output is supplied to the LED elements 91*a* to 91*l* of the LED module 9 thereby to emit light from the LED elements 91*a* to 91*l*. The optical output of the LED elements 91*a* to 91*l* is controlled by the optical output control unit 272.

In this illumination apparatus, as shown in FIG. 3, the housing 1 of the apparatus proper is grounded, and the printed board 94 of the LED module 9 is fixed closely to the inner wall of the housing 1 taking the heat radiation into consideration. As a result, the stray capacitance 30 exists between the printed board 94 and the apparatus proper 7. Once a common-mode noise is generated from a noise source 311 due to an impulse-like noise or the high-frequency variation which causes an unstable the grounding potential, a current b may flow into the LED elements 91*a* to 91*l* through the stray capacitance 30 by way of a path indicated by a dashed line.

FIG. 5A is a diagram for explaining a detailed configuration of the LED module 9 used for the illumination apparatus shown in FIG. 3. The LED elements 91*a* to 91*l* are connected in parallel to the first bypass capacitors 92*a* to 92*l*, respectively, on the one hand, and each group including a plurality of series-connected ones of the LED elements 91*a* to 91*l* is connected in parallel to the second bypass capacitors 93*a*, 93*b* and 93*c*. Assume that the point A of the negative line 9*b* is a grounding point constituting a reference. The bypass capacitors 93*a*, 93*b* and 93*c* reduce the AC impedance against the ground at each of connection points B, C and D of the series circuit of the LED elements 91*a* to 91*l*.

Figure 5B:
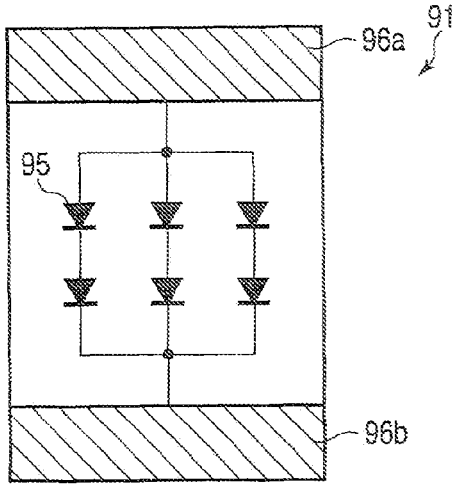
FIG. 5B is a diagram showing the configuration of LEDs in packaged form.

Incidentally, each of the LED elements 91*a* to 91*l* may be configured of a plurality of LEDs as shown in FIG. 5B. In FIG. 5B, three series circuits each including two LEDs 95 are connected in parallel between terminals 96*a* and 96*b*. In this way, the six LEDs 95 are packaged. The number of the LEDs making up the series circuit and the number of the LED series circuits connected in parallel are determined in accordance with a particular application. Also, according to this embodiment, the first bypass capacitor 92 is not necessarily provided for each LED element 91. The configuration in which one or several ones of the first bypass capacitors 92*a* to 92*l* are omitted is also included in the invention and has a similar advantage.

In the configuration described above, the noise current b which otherwise would flow into the LED elements 91*a* to 91*l* through the stray capacitance 30 due to the generation of a common-mode noise can be efficiently led to the grounding point A through a bypass formed of the second bypass capacitors 93*a*, 93*b* and 93*c* from the connection points B, C and D low in AC impedance against the ground. At the time of turning off the LED elements 91*a* to 91*l*, therefore, the LED element 91*a*, for example, connected to the high-potential side is positively prevented from being turned on erroneously by the noise current b (FIG. 3). Also, in the case where the dim light depth is large (dark light emission from LED), the dimmer function of the dim light signal generator 28 and the optical output control unit 272 prevents a flicker from being generated in the LED elements 91*a* to 91*l* by the noise current b. As described above, according to the invention, the adverse effect which the external noise such as the common-mode noise otherwise might have on the LED elements is positively removed.

First Modification

Figure 6:
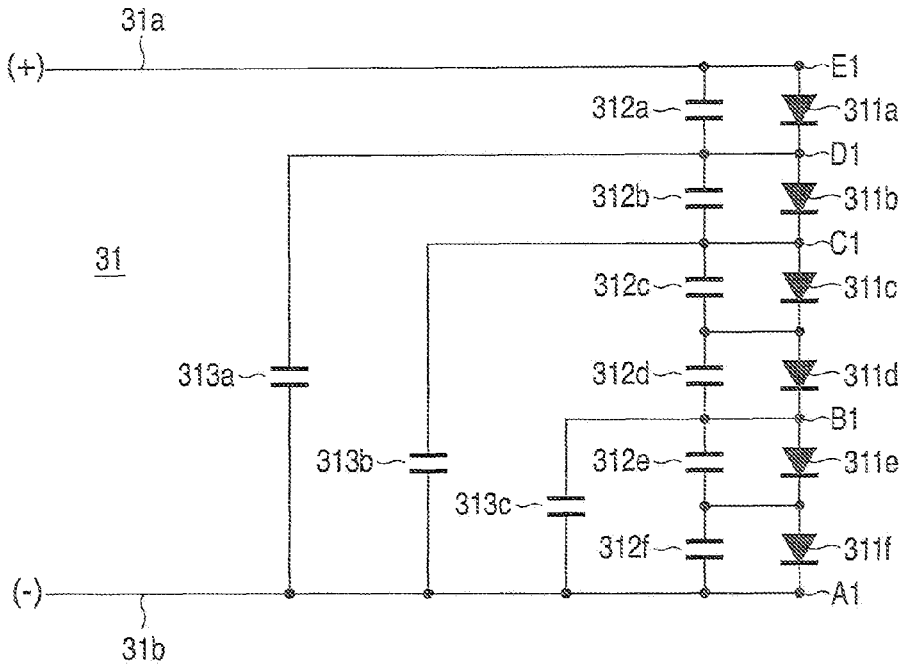
FIG. 6 is a diagram showing a general configuration of the LED module used for the illumination apparatus according to a modification of the first embodiment.

FIG. 6 shows an LED module according to a modification of the first embodiment described above.

In this modification, the LED module 31 is configured of a plurality of (six, in the shown case) LED elements 311*a* to 311*f* connected in series, and this series circuit is connected between a positive line 31*a* and a negative line 31*b* of the DC power output. The LED elements 311*a* to 311*f* are connected in parallel to first bypass capacitors 312*a* to 312*f*, respectively. Further, the series circuit of the LED elements 311*b* to 311*f* is connected in parallel to a second bypass capacitor 313*a*, the series circuit of the LED elements 311*c* to 311*f* is connected in parallel to a second bypass capacitor 313*b* and the series circuit of the LED elements 311*e* and 311*f* is connected in parallel to a second bypass capacitor 313*c*. These second bypass capacitors 313*a*, 313*b* and 313*c* have the negative line 31*b* as a grounding point A1, and with this grounding point A1 as a reference, the AC impedance against the ground at connection points B1, C1, D1 and E1 of the series circuit of the LED elements 311*a* to 311*f* is reduced for an improved bypass effect.

Also in this LED module 31, the noise current flowing into the LED elements 311*a* to 311*f* through the stray capacitance due to the generation of the common-mode noise can be led efficiently to the grounding point A1 through a bypass formed of the second bypass capacitors 313*a*, 313*b* and 313*c* from the connection points B1, C1, D1 and E1 low in AC impedance against the ground, and therefore, a similar advantage to the first embodiment can be achieved.

Second Modification

Figure 7:
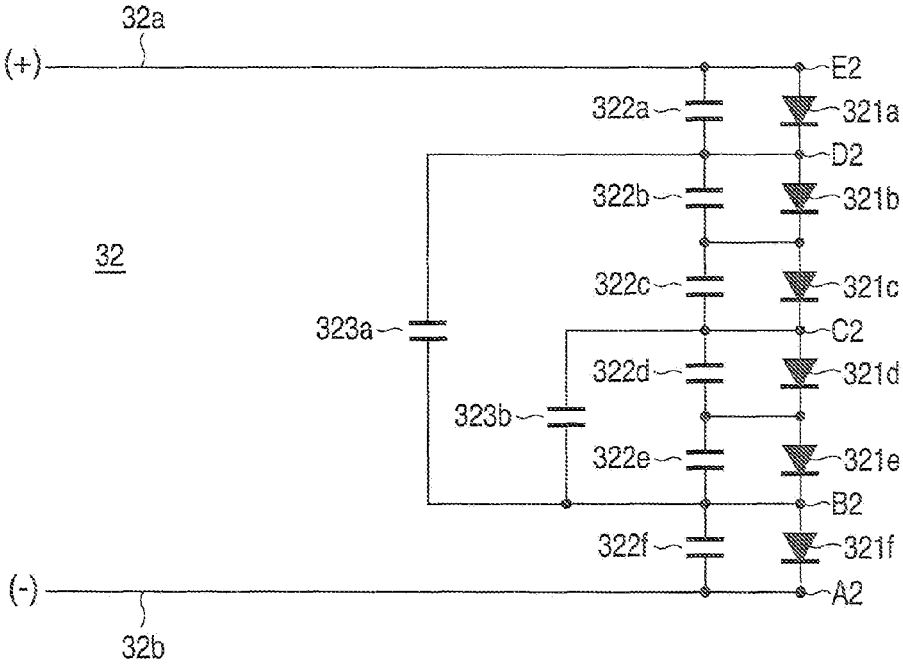
FIG. 7 is a diagram showing a general configuration of the LED module used for the illumination apparatus according to another modification of the first embodiment.

FIG. 7 shows an LED module according to another modification of the first embodiment.

In this modification, as shown in FIG. 7, the LED module 32 is configured of a plurality of (six, in the shown case) LED elements 321*a* to 321*f* connected in series, and this series circuit is connected between a positive line 32*a* and a negative line 32*b* of the DC power output. The LED elements 321*a* to 321*f* are connected in parallel to first bypass capacitors 322*a* to 322*f*, respectively. Further, the series circuit of the LED elements 321*b* to 321*e* is connected in parallel to a second bypass capacitor 323*a*, and the series circuit of the LED elements 321*d* and 321*e* is connected in parallel to a second bypass capacitor 323*b*. These second bypass capacitors 323*a* and 323*b* have the negative line 32*b* of the LED elements 321*a* to 321*f* as a grounding point A2, and with this grounding point A2 as a reference, the AC impedance against the ground at connection points B2, C2, D2 and E2 of the series circuit of the LED elements 321*a* to 321*f* is reduced for an improved bypass effect.

Also in this LED module 32, the current flowing into the LED elements 311*a* to 311*f* through the stray capacitance due to the generation of the common-mode noise can be led efficiently from the connection points B2, C2, D2 and E2 low in AC impedance against the ground to the grounding point A2 through the second bypass capacitors 323*a* and 323*b*, and therefore, a similar advantage to the first embodiment can be achieved.

Second Embodiment

In the first embodiment, the series-connected LED elements 91*a* to 91*l* are connected in parallel to the first bypass capacitors 92*a* to 92*l*, respectively. According to a second embodiment, in contrast, the first bypass capacitors are differently connected to make it possible to omit the second bypass capacitors.

Figure 8:
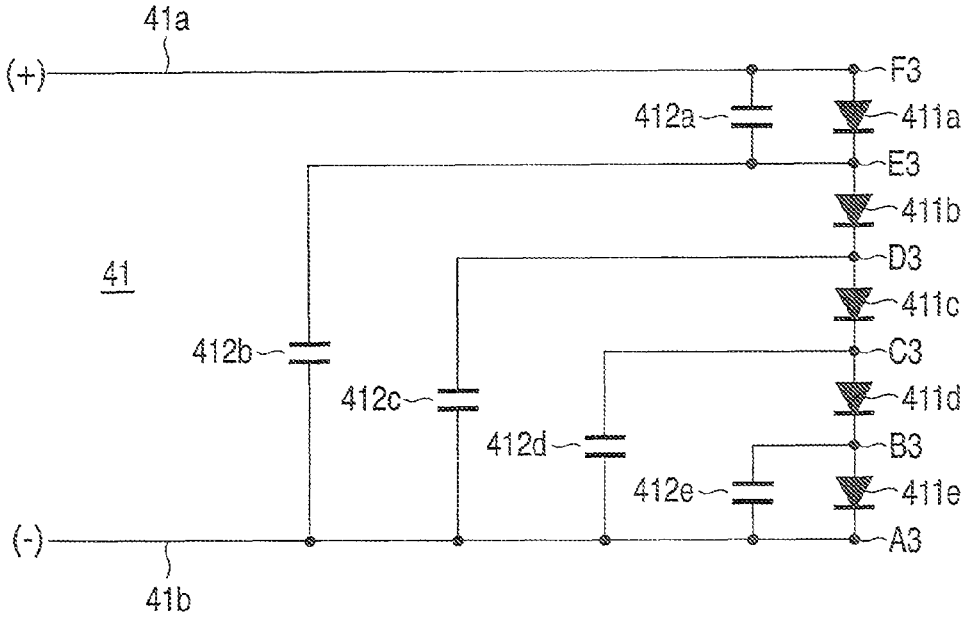
FIG. 8 is a diagram showing a general configuration of the LED module used for the illumination apparatus according to a second embodiment of the invention.

FIG. 8 shows a general configuration of an LED module 41, in which a plurality of (five, in the shown case) LED elements 411*a* to 411*e* are connected in series, and this series circuit is connected between the positive and negative lines 41*a* and 41*b* of the DC power output. Among the LED elements 411*a* to 411*e*, the LED element 411*a* is connected in parallel to a first bypass capacitor 412*a*. Also, the series circuit of the LED elements 411*b* to 411*e* is connected in parallel to a first bypass capacitor 412*b*, the series circuit of the LED elements 411*c* to 411*e* is connected in parallel to a first bypass capacitor 412*c*, the series circuit of the LED elements 411*d* and 411*e* is connected in parallel to a first bypass capacitor 412*d*, and further, the LED element 411*e* is connected in parallel to a first bypass capacitor 412*e*.

These first bypass capacitors 412*a* to 412*e* have the negative line 41*b* of the series circuit of the LED elements 411*a* to 411*e* as a grounding point A3, and with this grounding point A3 as a reference, the AC impedance against the ground at the desired connection points, that is, connection points B3, C3, D3, E3 and F3, for example, of the series circuit of the LED elements 411*a* to 411*e* is reduced for an improved bypass effect.

In this configuration, the noise current flowing into the LED elements 411*a* to 411*e* through the stray capacitance due to the generation of the common-mode noise can be efficiently led by the first bypass capacitors 412*a* to 412*e* to the grounding point A3 from the connection points B3, C3, D3, E3 and F3 low in AC impedance against the ground, and therefore, a similar advantage to the first embodiment can be achieved.

Also, since the first bypass capacitors 412*a* to 412*e* are not connected in series, even if the number of the LED elements connected in series is increased, the combined capacitance of the capacitors as a whole is not reduced and the low AC impedance against the ground can be maintained. Without using the second bypass capacitors, therefore, the apparatus can be configured of only the first bypass capacitors 412*a* to 412*e*, thereby making it possible to realize a more compact and inexpensive apparatus.

Modification

Figure 9:
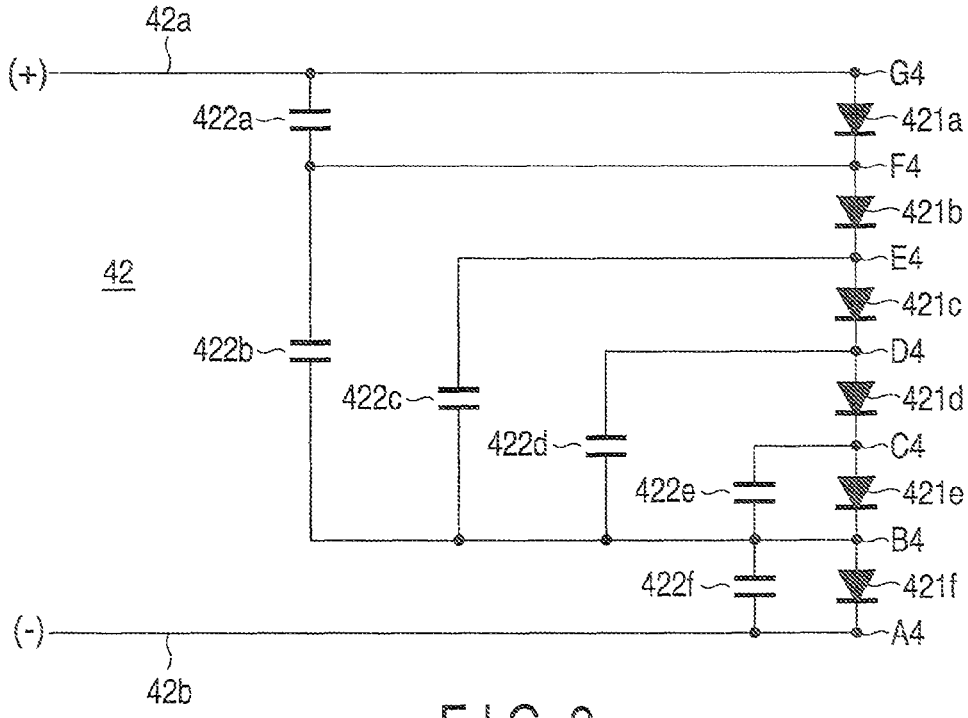
FIG. 9 is a diagram showing a general configuration of the LED module used for the illumination apparatus according to a modification of the second embodiment.

FIG. 9 shows an LED module as a modification of the LED module 41 according to the second embodiment.

In this modification, an LED module 42 is configured of a plurality of (six, in the shown case) LED elements 421*a* to 421*e* connected in series, and this series circuit is connected between a positive line 42*a* and a negative line 42*b* of the DC power output. Among the LED elements 421*a* to 421*f*, the LED element 421*a* is connected in parallel to a first bypass capacitor 422*a*. Also, the series circuit of the LED elements 421*b* to 421*e* is connected in parallel to a first bypass capacitor 422*b*, the series circuit of the LED elements 421*c* to 421*e* is connected in parallel to a first bypass capacitor 422*c*, and the series circuit of the LED elements 421*d* and 421*e* is connected in parallel to a first bypass capacitor 422*d*. Further, the LED element 421*e* is connected in parallel to a first bypass capacitor 422*e*, and the LED element 421*f* is connected in parallel to a first bypass capacitor 422*f*.

These first bypass capacitors 422*a* to 422*f* have the negative line 42*b* as a grounding point A4 of the series circuit of the LED elements 421*a* to 421*f*, and with this grounding point A4 as a reference, the AC impedance against the ground at connection points B4, C4, D4, E4, F4 and G4 of the series circuit of the LED elements 421*a* to 421*f* is reduced for an improved bypass effect.

Also in this configuration, the noise current flowing into the LED elements 411*a* to 411*f* through the stray capacitance due to the generation of the common-mode noise can be led to the grounding point A4 efficiently by the first bypass capacitors 422*a* to 422*f* from the connection points B4, C4, D4, E4, F4 and G4 low in AC impedance against the ground, and therefore, a similar advantage to the first embodiment can be achieved.

Also in this case, the first bypass capacitors 422*a* to 422*f* are not connected in series, and therefore, even if the number of the LED elements connected in series is increased, the combined capacitance of the capacitors as a whole is not reduced, and a low AC impedance against the ground can be maintained. As a result, the apparatus can be configured of only the first bypass capacitors 422*a* to 422*f* without the second bypass capacitors, thereby making it possible to reduce both the size and cost of the apparatus.

Third Embodiment

In the case where the LED elements connected in series are in a prime number, for example, the number of the LED elements connected in parallel to the second bypass capacitors may be unbalanced. In such a case, as long as a comparatively large current flows in the LED elements, the voltage applied to the LED elements is determined by the characteristics of the LED elements since the impedance of the LED elements themselves is small. In the case where the LED elements are used in an environment comparatively small in current due to the dimmer operation, etc., however, the impedance of the LED elements themselves is so large that the voltage divided by the second bypass capacitors is applied to the LED elements, and the light flux of the LED elements may be varied depending on the number of the LED elements. If a noise current flows into the LED elements due to the common-mode noise under this condition, the problem is posed that the light flux variation of the LED elements becomes considerable.

In view of this, according to a third embodiment, the light flux variation of the LED elements is prevented even in the case where the number of the LED elements connected in parallel to the second bypass capacitors is unbalanced.

Figure 10:
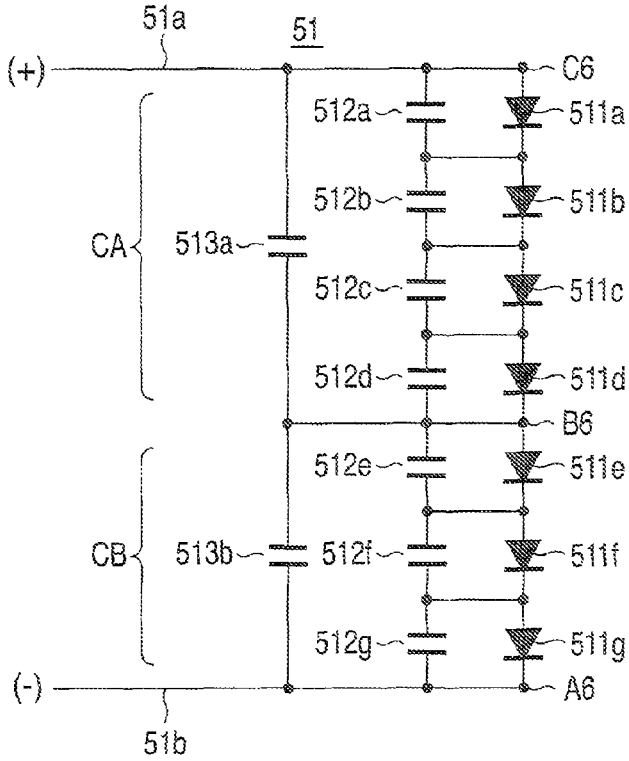
FIG. 10 is a diagram showing a general configuration of an LED module used for the illumination apparatus according to a third embodiment of the invention.

FIG. 10 shows a general configuration of the LED module 51, in which a plurality of (seven, in the shown case) LED elements 511*a* to 511*g* are connected in series, and this series circuit is connected between positive and negative lines 51*a* and 51*b* of the DC power output. These LED elements 511*a* to 511*g* are connected in parallel to first bypass capacitors 512*a* to 512*g*, respectively. Further, among the LED elements 511*a* to 511*g*, the series circuit of the LED elements 511*a* to 511*d* is connected in parallel to a second bypass capacitor 513*a*, and the series circuit of the LED elements 511*e* to 511*g* in parallel to a third bypass capacitor 513*b*.

In this case, the capacitance of the second and third bypass capacitors 513*a* and 513*b* is set to secure the equivalency among the noise voltages applied to the LED elements 511*a* to 511*g*. In the series circuit of the seven LED elements 511*a* to 511*g* shown, the series circuit of the four LED elements 511*a* to 511*d* is connected in parallel to the second bypass capacitor 513*a*, and the series circuit of the three LED elements 511*e* to 511*g* is connected in parallel to the third bypass capacitor 513*b*. In this case, assuming that the combined capacitance of the second bypass capacitor 513*a* and the first bypass capacitors 512*a* to 512*d* connected in parallel to the second bypass capacitor 513*a* is given as CA and the combined capacitance of the third bypass capacitor 513*b* and the first bypass capacitors 512*e* to 512*g* connected in parallel to the third bypass capacitor 513*b* as CB, then the ratio CA/CB of the combined capacitance is set to be the inverse ratio of the number of the LED elements, that is, to hold the relation CA/CB=¾.

With this configuration, even in the case where the number of the LED elements 511*a* to 511*g* connected in parallel to the second and third bypass capacitors 513*a* and 513*b* is unbalanced, the noise voltages applied to the LED elements 511*a* to 511*g* can be set substantially equivalent to each other. Thus, the light flux flicker in the LED elements 511*a* to 511*g* can be prevented.

Also in this case, the negative line 51*b* of the series circuit of the LED elements 511*a* to 511*g* is set as a grounding point A6, and with this grounding point A6 as a reference, the AC impedance against the ground at each of connection points B6 and C6 of the series circuit of the LED elements 511*a* to 511*g* can be reduced by the second and third bypass capacitors 513*a* and 513*b*. As a result, the noise current otherwise flowing into the LED elements 511*a* to 511*f* through the stray capacitance due to the generation of the common-mode noise can be efficiently led to the grounding point A6 from the connection points B5 and C5 low in AC impedance against the ground through a bypass formed of the second and third bypass capacitors 513*a* to 513*b*, and therefore, a similar advantage to the first embodiment can be achieved.

Fourth Embodiment

Figure 11:
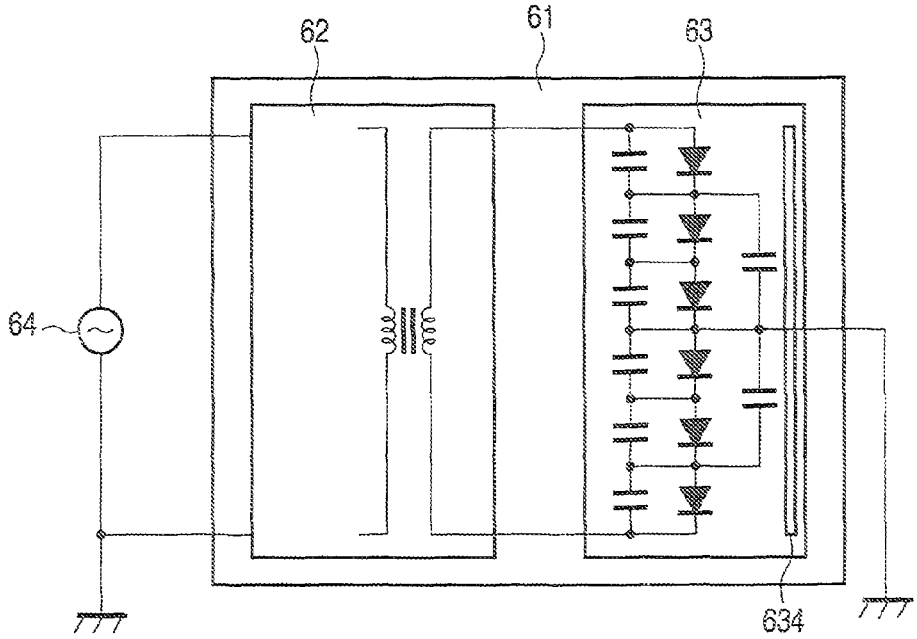
FIG. 11 is a diagram showing a general configuration of an illumination apparatus according to a fourth embodiment of the invention.

A fourth embodiment represents a case in which the power circuit of an insulating structure is used. As shown in FIG. 11, an apparatus proper 61 includes a power circuit 62 and an LED module 63 as a light-emitting device.

Figure 12:
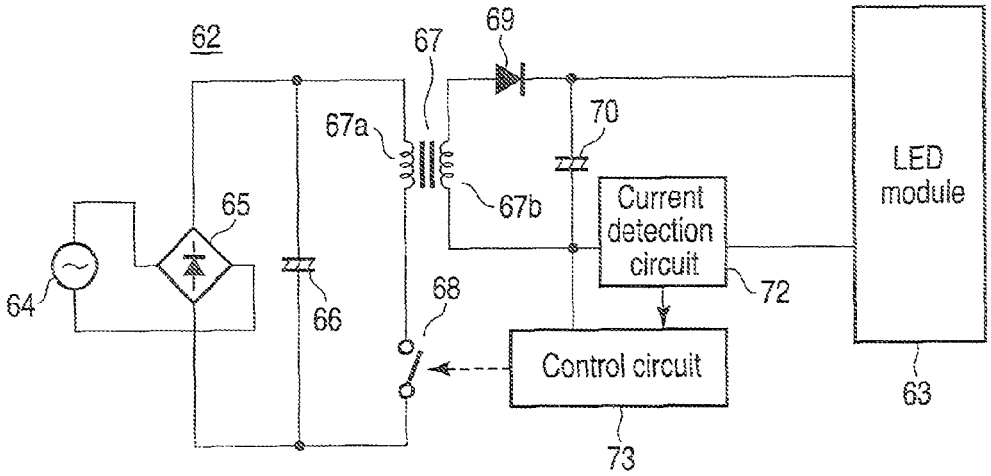
FIG. 12 is a diagram showing a general configuration of a power circuit used for the illumination apparatus according to the fourth embodiment.

FIG. 12 shows a general configuration of the power circuit 62.

In FIG. 12, an AC power supply 64 as a commercial power supply, not shown, is connected with an input terminal of a full-wave rectification circuit 65. The full-wave rectification circuit 65 generates a DC current by full rectification of the AC power from the AC power supply 64.

A smoothing capacitor 66 is connected in parallel between the positive and negative output terminals of the full-wave rectification circuit 65. The smoothing capacitor 66 smoothes the output of the full-wave rectification circuit 65.

A series circuit including a primary winding 67*a* of a switching transformer 67 providing a flyback transformer and a switching transistor 68 constituting a switching unit is connected across the smoothing capacitor 66. The switching transformer 67 including a secondary winding 67*b* magnetically coupled to the primary winding 67*a*.

The secondary winding 67*b* of the switching transformer 67 is connected with a rectification-smoothing circuit including a diode 69 of the shown polarity and a smoothing capacitor 70. The rectification-smoothing circuit makes up a DC output generating unit together with the switching transistor 68 and the switching transformer 67. The AC output generated from the secondary winding 67*b* of the switching transformer 67 is rectified by the diode 69. The rectification output is smoothed by the smoothing capacitor 70 and generated as a DC output.

The smoothing capacitor 70 is connected with an LED module 63. The LED module 63 is described later.

A current detection circuit 72 is connected between the LED module 63 and the secondary winding 67*b* of the switching transformer 67. The current detection circuit 72 detects the current flowing in the LED module 63 and outputs a detection signal corresponding to the detection current.

The current detection circuit 72 is connected with a control circuit 72 as a control unit. The control circuit 73 is driven by a power supply not shown, and operated to switch on/off the switching transistor 68 thereby to drive the switching transformer 67. In the process, the control circuit 73 compares the detection signal of the current detection circuit 72 with a reference value not shown, and based on the comparison result, controls the on/off operation of the switching transistor 68 thereby to control the DC power output supplied to the LED module 63.

Figure 13:
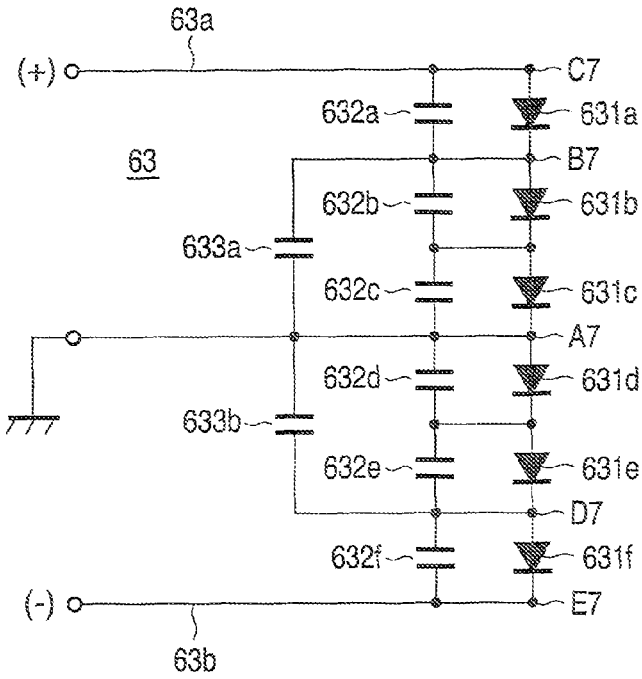
FIG. 13 is a diagram showing a general configuration of an LED module used for the illumination apparatus according to the fourth embodiment.

The LED module 63, as shown in FIG. 13, includes a plurality of (six, in the shown example) LED elements 631*a* to 631*f* connected in series as semiconductor light-emitting elements, and this series circuit is connected between positive and negative lines 63*a* and 63*b* of the DC power output. The LED elements 631*a* to 631*f* are connected in parallel to first bypass capacitors 632*a* to 632*f*, respectively. The current flowing into the LED elements 631*a* to 631*f* due to the common-mode noise is led through these first bypass capacitors 632*a* to 632*f* as a bypass. Further, among the LED elements 631*a* to 631*f*, the series circuit of the LED elements 631*b* and 631*c* is connected in parallel to a second bypass capacitor 633*a*, and the series circuit of the LED elements 631*d* and 631*e* is connected in parallel to a second bypass capacitor 633*b*. The connection point of the LED elements 631*c*, 631*d* (the connection point of the second bypass capacitors 633*a* and 633*b*) is grounded. The second bypass capacitors 633*a* and 633*b* reduce the AC impedance against the ground at connection points B7, C7, D7 and E7 of the series circuit of the LED elements 631*a* to 631*f* with a grounding point A7 of the connection point of the LED elements 631*c* and 631*d* as a reference thereby to improve the bypass effect. These LED elements 631*a* to 631*f*, the first bypass capacitors 632*a* to 632*f* and the second bypass capacitors 633*a* and 633*b* are also mounted on a printed board 634 and configured as the LED module 63 as shown in FIG. 11.

In the power circuit 62 shown in FIG. 12, the AC power of the AC power supply 64 is full-wave rectified by the full-wave rectification circuit 65, and supplied to the smoothing capacitor 66, the switching transformer 67 and the switching transistor 68.

Under this condition, the switching transformer 67 is driven by the on/off operation of the switching transistor 68 under the control of the control circuit 73. In this case, energy is accumulated by turning on the switching transistor 68 and supplying the current to the primary winding 67*a* of the switching transformer 67, while the energy accumulated in the primary winding 67*a* is discharged through the secondary winding 67*b* by turning off the switching transistor 68. As a result, a DC output is generated across the smoothing capacitor 70, and supplied the DC output to the LED module 63 thereby to control the optical output of the LED elements 631*a* to 631*f*.

Also in this case, upon generation of the common-mode noise from a noise source such as an impulse noise or a high-frequency variation which cause an unstable grounding potential, a noise current may flow in the LED elements 631*a* to 631*f*. This noise current, however, can be efficiently led to the grounding point A7 through the second bypass capacitors 633*a* and 633*b* from the connection points B7 to E7 low in AC impedance against the ground. Thus, a similar advantage to that of the first embodiment is achieved.

Modification 1

Figure 14:
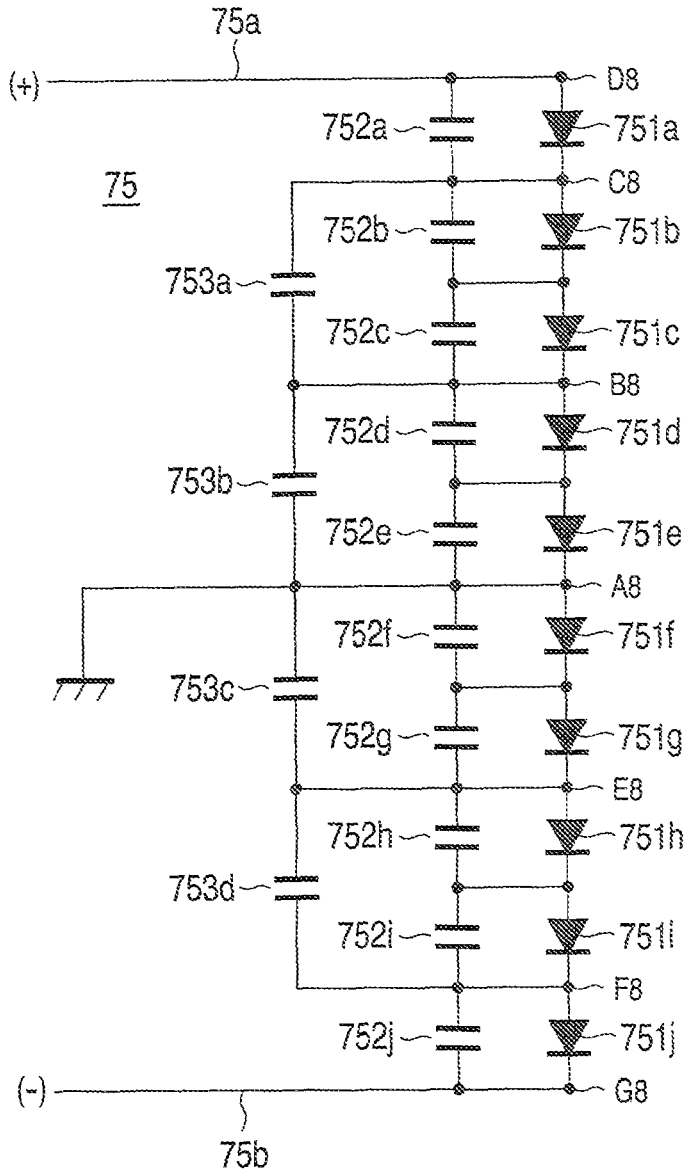
FIG. 14 is a diagram showing a general configuration of the LED module used for the illumination apparatus according to a modification of the fourth embodiment.

FIG. 14 shows a modification of the LED module described in the fourth embodiment.

In this modification, an LED module 75 is configured of a plurality of (ten, in the shown case) LED elements 751*a* to 751*j* connected in series, and this series circuit is connected between a positive line 75*a* and a negative line 75*b* of the DC output. These LED elements 751*a* to 751*j* are connected in parallel to first bypass capacitors 752*a* to 752*j*, respectively. Further, among the LED elements 751*a* to 751*j*, the series circuit of the LED elements 751*b* and 751*c* is connected in parallel to a second bypass capacitor 753*a*, the series circuit of the LED elements 751*d* and 751*e* is connected in parallel to a second bypass capacitor 753*b*, the series circuit of the LED elements 751*f* and 751*g* is connected in parallel to a second bypass capacitor 753*c*, and the series circuit of the LED elements 751*h* and 751*i* is connected in parallel to a second bypass capacitor 753*d*.

The connection point of the LED elements 751*e* and 751*f* (a connection point A8 of the second bypass capacitors 753*b* and 753*c*) is grounded. In this case, the second bypass capacitors 753*a* to 753*d* have the connection point A8 of the LED elements 751*e* and 751*f* as a grounding point, and with this grounding point A8 as a reference, the AC impedance against the ground at connection points B8, C8, D8, E8, F8 and G8 of the series circuit of the LED elements 751*a* to 751*j* is reduced thereby to improve the bypass effect.

By doing so, even in the case where the noise current flows into the LED elements 751*a* to 751*j* due to the generation of the common-mode noise, the current involved can be led efficiently to the grounding point A8 by the second bypass capacitors 753*a* to 753*d*, and therefore, an effect similar to that of the first embodiment is obtained.

Modification 2

Figure 15:
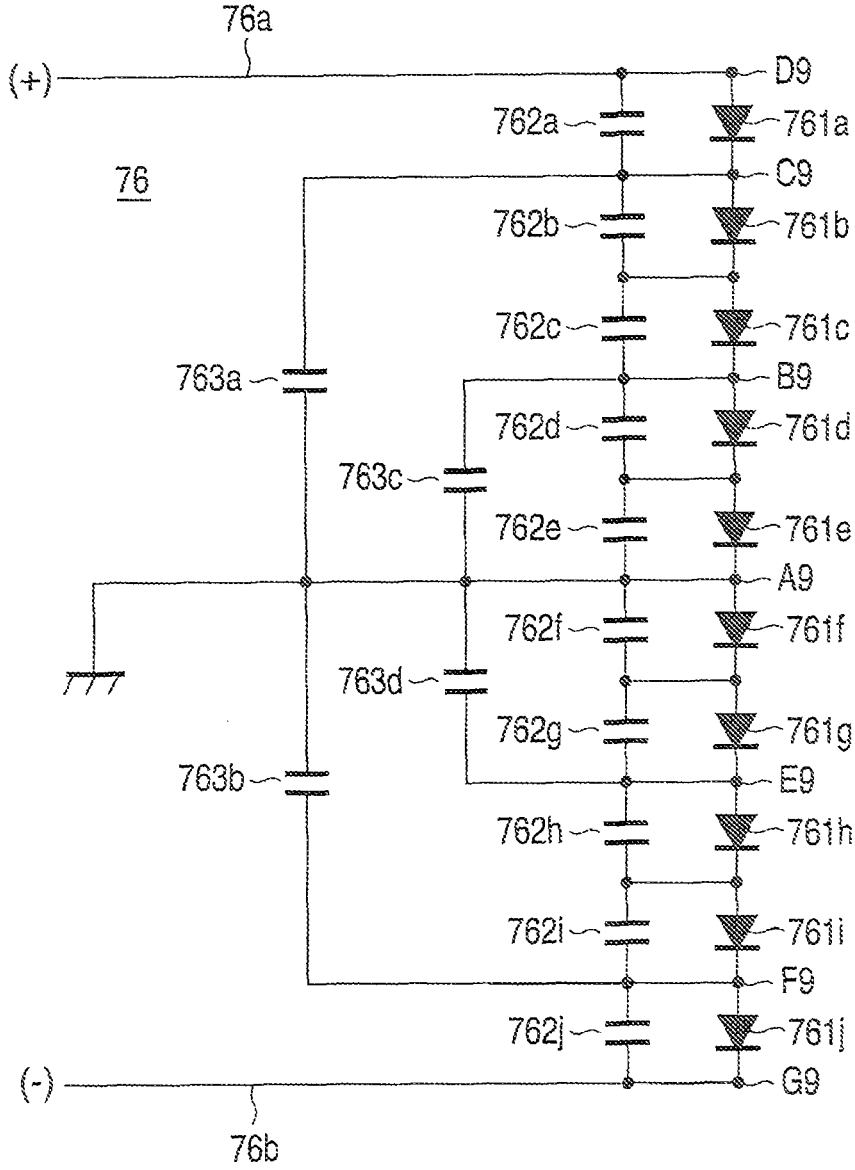
FIG. 15 is a diagram showing a general configuration of the LED module used for the illumination apparatus according to another modification of the second embodiment.

FIG. 15 shows another modification of the LED module described in the fourth embodiment.

In this modification, an LED module 76 is configured of a plurality of (ten, in the shown case) LED elements 761*a* to 761*j* connected in series, and this series circuit is connected between a positive line 76*a* and a negative line 76*b* of the DC output. These LED elements 761*a* to 761*j* are connected in parallel to first bypass capacitors 762*a* to 762*j*, respectively. Further, among the LED elements 761*a* to 761*j*, the series circuit of the LED elements 761*b* to 761*e* is connected in parallel to a second bypass capacitor 763*a*, the series circuit of the LED elements 761*f* to 761*i* is connected in parallel to a second bypass capacitor 763*b*, the series circuit of the LED elements 761*d* and 761*e* is connected in parallel to a second bypass capacitor 763*c*, and the series circuit of the LED elements 761*f* and 761*g* is connected in parallel to a second bypass capacitor 763*d*.

The connection point of the LED elements 761*e* and 761*f* (the connection point of the second bypass capacitors 763*a* and 763*b* and the connection point of the second bypass capacitors 763*c* and 763*d*) is grounded. In this case, the second bypass capacitors 763*a* to 763*d* have a connection point A9 of the LED elements 761*e* and 761*f* as a grounding point, and with this grounding point A9 as a reference, the AC impedance against the ground at connection points B9, C9, D9, E9, F9 and G9 of the series circuit of the LED elements 761*a* to 761*j* is reduced thereby to improve the bypass effect.

By doing so, the noise current which otherwise might flow into the LED elements 761*a* to 761*j* due to the generation of the common-mode noise can be led to the grounding point A9 by the second bypass capacitors 763*a* to 763*d*, and therefore, an effect similar to that of the first embodiment is obtained.

Modification 3

Figure 16:
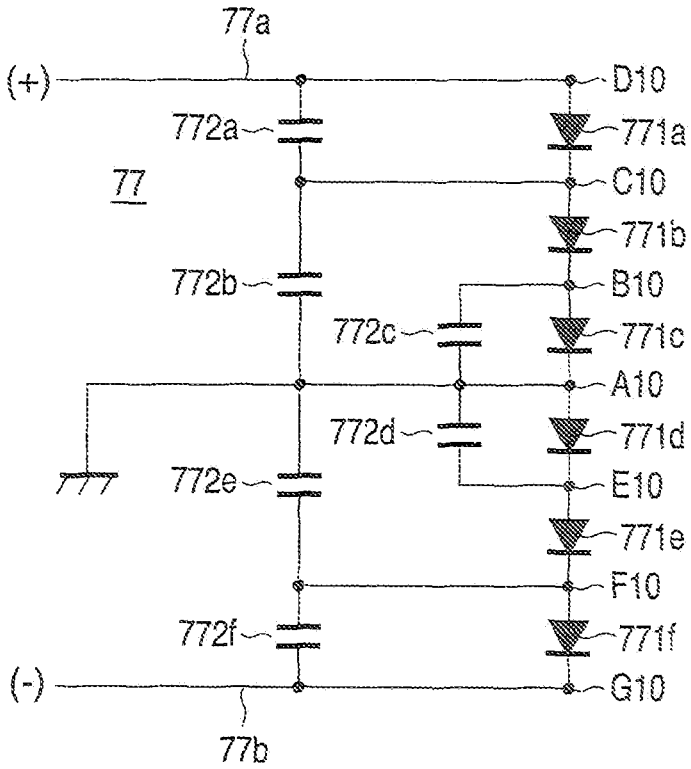
FIG. 16 is a diagram showing a general configuration of the LED module used for the illumination apparatus according to still another modification of the second embodiment.
Figure 17:
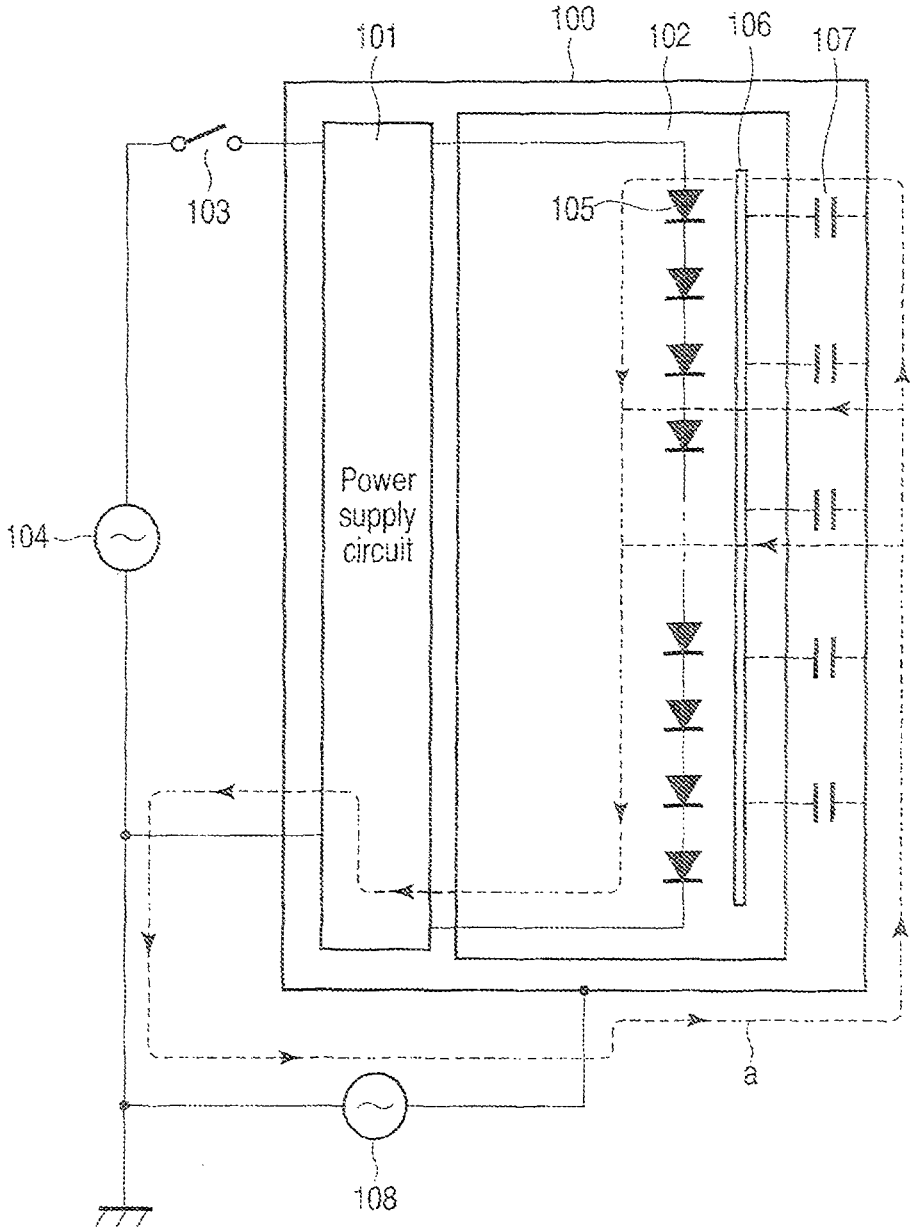
FIG. 17 RELATED ART
FIG. 17 is a diagram showing a general configuration of a conventional illumination apparatus.

FIG. 16 shows still another modification of the LED module according described in the fourth embodiment.

In this modification, an LED module 77 is configured of a plurality of (six, in the shown case) LED elements 771*a* to 771*f* connected in series, and this series circuit is connected between a positive line 77*a* and a negative line 77*b* of the DC output. Among the LED elements 771*a* to 771*f*, the LED element 771*a* is connected in parallel to a first bypass capacitor 772*a*, the series circuit of the LED elements 771*b* and 771*c* is connected in parallel to a first bypass capacitor 772*b*, and the LED element 771*c* is connected in parallel to a first bypass capacitor 772*c*. Further, the LED element 771*d* is connected in parallel to a first bypass capacitor 772*d*, the series circuit of the LED elements 771*d* and 771*e* is connected in parallel to a first bypass capacitor 772*e*, and the LED element 771*f* is connected in parallel to a first bypass capacitor 772*f*.

The connection point of the LED elements 771*c* and 771*d* (the connection point of the first bypass capacitors 773*c* and 773*d*, and the connection point of the first bypass capacitors 772*c* and 772*d*) is grounded. In this case, the first bypass capacitors 772*a* to 772*f* have the connection point of the LED elements 771*c* and 771*d* as a grounding point A10, and with this grounding point A10 as a reference, the AC impedance against the ground at connection points B10, C10, D10, E10, F10 and G10 of the series circuit of the LED elements 771*a* to 771*f* is reduced thereby to improve the bypass effect.

By doing so, a noise current which otherwise might flow into the LED elements 771*a* to 771*f* due to the generation of the common-mode noise can be efficiently led through a bypass to the grounding point A10 by the first bypass capacitors 772*a* to 772*f*, and therefore, an effect similar to that of the first embodiment is obtained.

Also, even in the case where the number of LED elements connected in series increases, the combined capacitance of the capacitors as a whole is not reduced since the first bypass capacitors 772*a* to 772*f* are not connected in series, thereby making it possible to maintain a low AC impedance against the ground. Therefore, the apparatus can be configured of only the first bypass capacitors 772*a* to 772*f* without second bypass capacitors, thereby making it possible to realize a more compact, inexpensive apparatus.

Incidentally, the present invention is not limited to the embodiments described above, but can be embodied in various modifications without departing from the spirit of the invention. Although the control unit 27 is explained as an analog circuit in the embodiments above, for example, a control method using a microcomputer or a digital process can be employed with equal effect.

Further, the embodiments described above include various stages of the invention, and the various inventions can be extracted by appropriate combination of a plurality of constituent features disclosed. For example, even in the case where several of all the constituent features shown in the embodiments are deleted, a configuration less the particular constituent features can be extracted as the invention as long as the problem to be solved by the invention described in the related column above can be solved and the advantages described in the related column are obtained.

The above description is the embodiments of the present invention, and the apparatus and the method of the invention are not limited thereto, and various modified examples can be implemented. Such modified examples are included in the present invention. Further, apparatus or methods which are configured by appropriately combining the components, the functions, the features, or the steps of the method in the respective embodiments are included in the present invention.

What is claimed is:

1. A light-emitting device comprising:

a plurality of semiconductor light-emitting diodes connected in series with each other and mounted on a printed board;

a plurality of first bypass capacitors mounted on the printed board, one connected in parallel to each of the semiconductor light-emitting diodes, respectively; and at least one second bypass capacitor mounted on the printed board and connected in parallel to a group of said first bypass capacitors in such a manner as to reduce the AC impedance at desired connection points of said plurality of the semiconductor light-emitting diodes against the grounding point of said plurality of the semiconductor light-emitting diodes.

2. The light-emitting device according to claim 1, further comprising a third bypass capacitor mounted on the printed board and connected to another group of a predetermined number of the first bypass capacitors different from the group of the first bypass capacitors connected to the at least one second bypass capacitor;

wherein the ratio between a combined capacitance as connected of the at least one second bypass capacitor and the first bypass capacitors connected to the at least one second bypass capacitor and a combined capacitance as connected of the third bypass capacitor and the predetermined number of the first bypass capacitors is set to be an inverse ratio between the number of the semiconductor light-emitting diodes connected to said at least one second bypass capacitor and the predetermined number.

3. An illumination apparatus comprising:

the light-emitting device according to claim 1; and a power supply unit which supplies a DC output to the light-emitting device.

4. The light-emitting device according to claim 1, further comprising a dimmer which adjusts the light emission strength of the semiconductor light-emitting diodes.

5. The light-emitting device according to claim 2, further comprising a dimmer which adjusts the light emission strength of the semiconductor light-emitting diodes.

6. An illumination apparatus comprising:

the light-emitting device according to claim 2; and a power supply unit which supplies a DC output to the light-emitting device.

7. A light-emitting device comprising:

a plurality of semiconductor light-emitting diodes connected in series with each other and mounted on a printed board; and a plurality of first bypass capacitors mounted on the printed board, one connected in parallel to each of the semiconductor light-emitting diodes, respectively, in such a manner as to reduce the AC impedance at desired connection points of said plurality of the semiconductor light-emitting diodes against the grounding point of said plurality of the semiconductor light-emitting diodes.

8. The light-emitting device according to claim 7, further comprising a dimmer which adjusts the light emission strength of the semiconductor light-emitting diodes.

* * * * *